United States Patent [19]

Davis

[11] Patent Number: 4,489,864

[45] Date of Patent: Dec. 25, 1984

[54] INTERFERENCE STOP PUNCH-OUT CLOSURE

[75] Inventor: R. Melvin Davis, Reedsville, Pa.

[73] Assignee: Weatherchem Corporation, Twinsburg, Ohio

[21] Appl. No.: 489,260

[22] Filed: Apr. 27, 1983

[51] Int. Cl.[3] ..... B65D 47/10

[52] U.S. Cl. ..... 222/541; 222/565; 222/556; 222/480; 220/253; 220/258

[58] Field of Search ..... 220/258, 253, 268, 269; 222/480, 541, 565, 556, 554; 229/43

[56] References Cited

U.S. PATENT DOCUMENTS

| | | | |
|---|---|---|---|
| 2,961,132 | 11/1960 | Ankney | 222/480 |
| 3,874,580 | 4/1975 | Weatherhead | 220/253 |
| 3,877,604 | 5/1975 | Brown | 220/268 |
| 3,912,128 | 10/1975 | Ziemann | 222/541 |
| 4,308,979 | 1/1982 | Otterson | 220/253 |

*Primary Examiner*—George T. Hall

*Attorney, Agent, or Firm*—Pearne, Gordon, Sessions, McCoy, Granger & Tilberry

[57] ABSTRACT

A tubular container is provided with a top end punch-out closure comprising a one-piece plastic cap and a rotor on the cap. A punch-out tab defined by a tearing web on the cap can be forced by finger pressure to hinge down from the cap to form a dispensing opening that is aligned with the major dispensing opening on the rotor at the fully open dispensing condition of the rotor. The side of the tab opening opposite the hinge has an arcuate edge that is substantially congruent with a corresponding arcuate edge of the major dispensing opening when the closure is fully open, with the radius of the latter being slightly smaller than the radius of the former to maintain an interference fit if the tab breaks off. The substantially congruent arcuate shapes allow exertion of downward compressive finger pressure at a location sufficiently close to the tearing web to indirectly apply tensile pressure with sufficient concentration to rupture the web.

4 Claims, 6 Drawing Figures

INTERFERENCE STOP PUNCH-OUT CLOSURE

BACKGROUND AND SUMMARY OF THE INVENTION

This invention relates generally to reclosable end closures for containers, and more specfically to plastic end closures which seal the container for shipping and storage and which include a punch-out tab for unsealing the container, which can then be reclosed and reopened by rotation of a rotor forming part of the closure.

Plastic end closures of this reclosable type may include a one-piece stationary cap which closes the end of the container and a one-piece rotor or disc which provides various sizes and shapes of dispensing openings for dispensing the contents of the container. The one-piece cap of such closures includes a punch-out tab which seals the container during shipping and storage and which is defined by a reduced thickness tearing web. The reduced thickness tearing web is located at the bottom of a groove in the container end wall formed by the cap. The opening left by removal of the tab is substantially congruent with the largest dispensing opening in the rotor at one rotative position, to thereby establish the maximum opening for dispensing. The groove is interrupted or crossed by one or two hinge pins molded integrally with the end wall. To open the tab, downward finger pressure is manually exerted on a portion of the edge of the tab, at a point remote to the hinge pin means to thereby rupture the tearing web at that edge portion and initiate tearing (rupture) of the web. As finger pressure is maintained, the tearing of the web continues and the tab hinges inwardly from the end wall around the hinge pin means.

In such end closures, the punch-out tab is offset from the axis of rotation of the rotor or disc. The container is reclosed by rotating the rotor or disc to a position where no dispensing opening in the disc is aligned with the opening left by removal of the punch-out tab.

In one form of such end closures, the punch-out tab has been designed to be completely removable after opening, as exemplified in U.S. Pat. Nos. 2,961,132 and 3,912,128. In another form, the tab is allowed to remain hinged downwardly into the interior of the container, and need not be separately disposed of. In both such forms, the hinge pin means may break during opening, causing the tab to fall into the contents of the container. Subsequently, during dispensing of the contents of the container, the tab flows along with the other contents and tends to be dispensed therewith out through the dispensing opening. This may occur without knowledge of the user who may not see the tab and who may not be the person who originally opened the container, or who may forget the tab is in it.

In many packaging applications, the mixing of the tab with the contents of the reclosable container is nor objectionable in itself, but it is highly objectionable if there is a chance that the tab may be accidentally dispensed along with the contents intended to be dispensed.

Accidental dispensing of a punch-out tab has been positively avoided in a non-reclosable metallic container by providing an open-centered camming ring rotatably fixed to the container end wall and used to punch out a circular tab in the container end wall, as in U.S. Pat. No. 3, 877,604. In such container, the axis of the camming ring is not offset from the tab opening, as is the the axis of the rotor of a reclosable closure, but on the contrary is coaxial with the circular tab.

In such non-reclosable container, the open center of the camming ring is of a smaller diameter than the circular tab, and covers the edge of the tab so that manual pressure directly at the edge cannot be exerted. Covering of the edge of the tab, or of the edge of the opening left by the tab, is necessary to establish the desired interference fit. However, downward compressive pressure on the edge of the tab is still relied on, even though the edge is covered, such downward compressive pressure being provided by a camming action between the overlying coaxial ring and cam surfaces formed in the tab at the edge of the tab.

Such a container cannot be made reclosable by a rotor or disc with an axis of rotation offset from the opening left by the tab, because the coaxial camming ring interferes. I have determined however that rupturing of the covered edge of a punch-out tab in plastic end closures, of conventional composition such as polystyrene, can be satisfactorily accomplished without the imposition of downward compressive pressure at a covered tab edge, and by reliance instead on indirect application of tensile pressure to the edge through manual compressive pressure on the exposed parts of the tab radially inward of the covered edge.

The present invention provides for applying tab-edge rupturing forces in this manner, and for the first time accomplishes positive prevention of accidental dispensing of a punch-out tab in a plastic end closure of the reclosable kind. The interference fit which prevents accidental dispensing of the tab forces reliance on indirect application of tensile pressure to rupture the tab edge, but near congruency between at least a portion of the tab-edge and a portion of the largest opening in the rotor is sufficient to allow this indirect application of tensile pressure to be effective.

BRIEF DESCRIPTION OF THE DRAWINGS

A presently preferred embodiment of the invention is illustrated in the drawings, wherein.

DETAILED DESCRIPTION OF THE DRAWINGS

Figure 1:
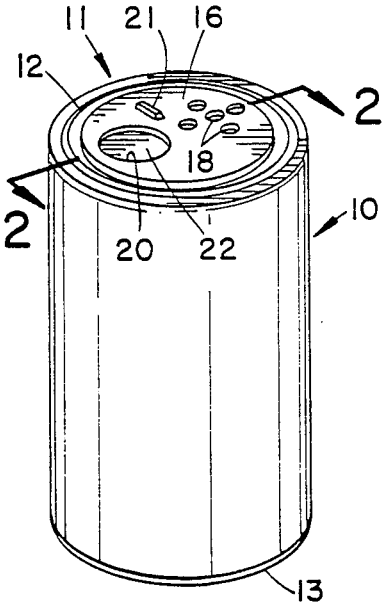
FIG. 1 is an isometric view of a container and end closure utilizing the invention.

Shown in the drawings is a tubular container 10 having a top end closure 11 and a bottom end closure 13 (FIG. 1). The top end closure 11 includes a one-piece plastic cap 12 adapted to be secured to the top end of the container and a rotor 16 rotatably connected and interlocked with the cap 12 by a boss 17 which projects through mating hole formed in the end wall portion 14 of the cap 12.

The rotor 16 is provided with at least one dispensing opening and in the illustrated container is provided with the major dispensing opening 20 and a pattern of smaller openings 18. The rotor 16 may also be provided with a handle or rib 21 to provide a purchase or grip for ready rotation of the rotor by a user.

Figure 2:
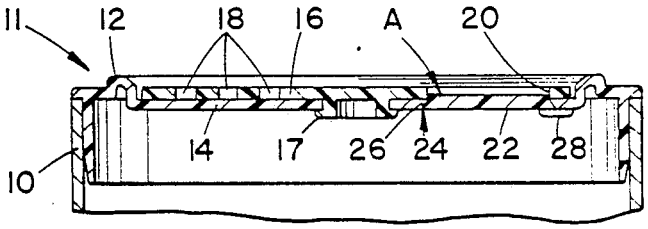
FIG. 2 is a fragmentary enlarged cross-sectional view of the top end of the container seen in FIG. 1.

A removable tab 22 is defined by a reduced thickness tearing web 24 (FIG. 2) formed in the end wall 14. A groove 26 extends from the top side of the end wall 14 through the majority of the thickness thereof, the remaining thickness providing the tearing web 24. Prior to first opening of the tab 22, the tearing web 24 is intact and seals the container during shipping and storage. At this stage, the rotor may be oriented as seen in FIGS. 1 and 2 with the major opening 20 oriented directly over the removable tab 22. The tab 22 is somewhat thicker than the remainder of the end wall 14. This contributes to ease of opening and provides a detent by interengagement with the sides of the major opening 22 to hold the rotor in registered position with the tab for ready opening by the user.

Hinge pin means such as the hinge pin 28 is molded integrally with the end wall 14 and extends across the tearing web 24 and groove means 26 from the end wall 14 to the punch-out tab 22. The hinge pin means 28 preferably extends on the bottom surface of the container end wall 14, as shown, although the hinge pin means may less preferably take some other form such as for example, simply an interruption along the peripheral extent of the groove 26.

Figure 3:
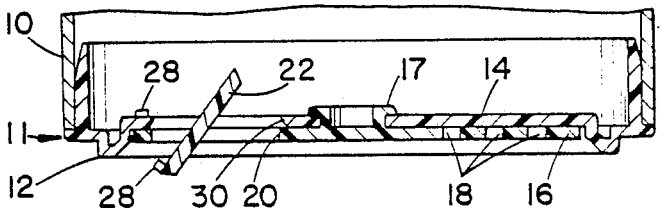
FIG. 3 is a fragmentary enlarged cross-sectional view of the top end of the container in inverted position and with the tab completely broken off and lodged in the dispensing openings.

When the tab 22 is opened, it hinges inwardly on the hinge means 28, and there is a risk that the hinge means 28 will break when the tab 22 is opened, or subsequently to its opening, allowing the tab to drop into the interior of the container 10 to become mixed with other contents. As previously mentioned, in many packaging applications this may not be objectionable in itself, but the chance that the tab may then be accidentally dispensed along with the regular contents of the container is highly objectionable. The present invention provides an interference fit to prevent this, thereby forcing reliance on indirect application of tensile pressure to rupture the tab edge. Near-congruency is maintained between at least a portion of the tab edge and a portion of the largest opening in the rotor to allow such indirect application of pressure to be effective. Preferably, the tab and the major outer dispensing opening are circular. Thus, as shown in the drawings, the major outer dispensing opening 30 is shaped as a circle with a given radius, and the tearing web 24 is formed in the end wall 14 in the shape of a circle with a radius just exceeding such given diameter of opening 20 so that, even though the opening 30 left by the tab is substantially congruent with the major opening 20 in the rotor when they are in register, the tab cannot pass through the dispensing opening in the rotor no matter what their relative orientations. As seen in FIG. 3, when the container is inverted and contents are pouring through the substantially congruent openings 30 and 20, a loose tab 22 whose hinge means 28 has broken cannot be inadvertently dispensed, no matter what its orientation, because the constant diameters of the two circular shapes of elements 22 and 20 will always interfere with each other in every angular or rotated position of the tab 22.

Figure 4:
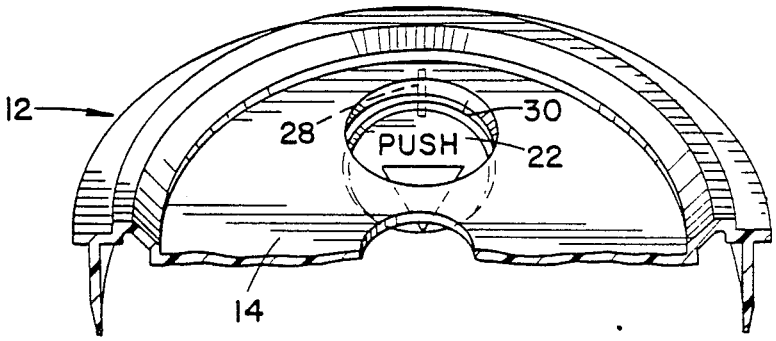
FIG. 4 is a slightly further enlarged isometric view, partly broken away, which omits the rotor and shows only the plastic cap of the top end closure, with the tab shown in opened condition.

The tearing web 24 is readily rupturable by exertion of finger pressure on the tab, near the edge opposite to the hinge pin means 28, as may be encouraged by a suitable legend molded into the top of the tab 22 as indicated in FIG. 4. Although the finger may not conveniently push against the tab at the very leftmost extremity (as viewed in FIG. 2) of opening 22, the arcuate shapes of the edges of opening 20 and of substantially congruent tab 22, at least at the general location opposite the hinge pin means 28, allow the finger to exert downward compressive pressure at a location, say at the point indicated by arrow A in FIG. 2, that is reasonably close to tearing web 24, the proximity being such as to indirectly apply tensile pressure with sufficient concentration to readily initially tear (rupture) the web 24. From the point of initial tear (rupture), the tearing web readily progressively tears around each side of the periphery of the tab 22 to allow the tab to hinge, on the hinge pin means 28, inwardly from the end wall 14 as shown in FIG. 5.

Figure 5:
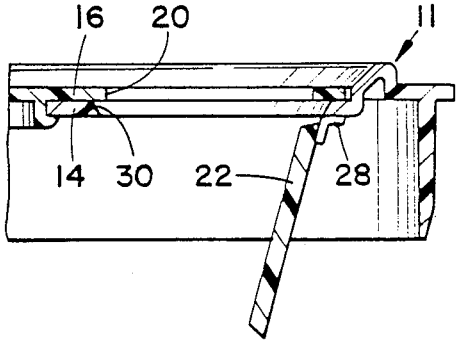
FIG. 5 is a fragmentary non-sectional view on still a larger scale showing the top end closure with the tab opened and the rotor in dispensing position.

Opening of the tab 22 forms an inner dispensing opening 30 (FIGS. 3–6) which, together with the major outer dispensing opening 20, establishes a fully opened dispensing condition of the end closure at the rotative position of the rotor illustrated in FIG. 5. It is functionally and aesthetically desirable that these two openings be substantially congruent in their entireties to thereby establish the maximum opening for dispensing without substantial restriction of one by the other and without unsightly inconsistencies in the shapes of the two as the rotor is moved to bring them toward or away from register with each other. Therefore, as previously mentioned, it is preferable that both the tab and the largest opening of the rotor be circular. However if each is not completely circular, at least one side of each is arcuate, with such arcuate portions being interrelated as above described. The remaining portions of the tab periphery should then exceed the radius of the tab's arcuate portion and/or the remaining portions of the periphery of the largest rotor opening should fall short of the radius of the arcuate potion of that opening, so as to preserve the interference fit in all possible relative orientations.

Figure 6:
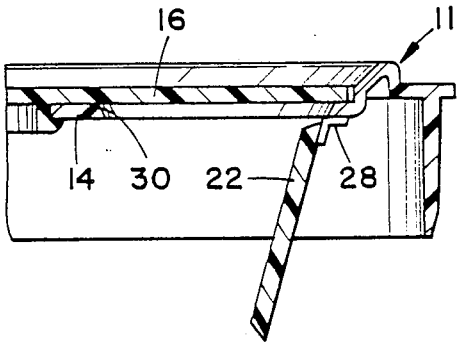
FIG. 6 is a view similar to FIG. 5 showing the rotor in reclosed position.

When the tab 22 has been opened as shown in FIG. 5, and it is then desired to reclose the container, perhaps after dispensing part of its contents, the rotor 16 is turned until an unapertured portion thereof covers the inner dispensing opening as shown in FIG. 6.

It should be evident that this disclosure is by way of example and that various changes may be made by adding, modifying or eliminating details without departing from the fair scope of the teaching contained in this disclosure. For example, more than one hinge pin may be employed. The invention is therefore not limited to particular details of this disclosure except to the extent that the following claims are necessarily so limited.

What is claimed is:

1. A reclosable punch-out end closure for the top end of a tubular container, said reclosable end closure comprising a one-piece plastic cap adapted to be secured to the top end of the container, said cap including a container end wall, said cap also including a punch-out tab defined by a reduced thickness tearing web formed in said end wall, groove means in said end wall extending from one or both surfaces of said end wall to said tearing web, hinged pin means molded integrally with said end wall and extending across said tearing web and groove means from said end wall proper to said punch-out tab, said tab having an arcuate edge at least at the side opposite said hinge pin means, rupture and tearing of said tearing web at the time of opening allowing said tab to hinge, on said hinge pin means, inwardly from said end wall to form an inner dispensing opening in the end wall, said end closure also including a rotor carried on said one-piece plastic cap, at least one dispensing opening formed in the rotor, said at least one opening being the major outer dispensing opening of the closure and having an arcuate edge which registers substantially congruently with said arcuate edge of said inner dispensing opening at the one rotative position of said rotor at which the fully open dispensing condition of said end closure is to be established, said hinge pin means being subject to failure during or following opening of the tab whereby if the hinge pin means breaks and the tab falls into the container then during dispensing the tab flows along with the contents of the container and tends to be dispensed therewith, said arcuate edge of said major outer dispensing opening having a given radius, the arcuate shape of said tearing web having a radius just exceeding said given radius to thereby establish potential interference fits of said tab with said major outer dispensing opening in all possible relative orientations between the two, whereby if said hinge pin means breaks, said tendency of the tab to be dispensed is positively overcome by an interference stop established by said interference fit, said arcuate shape of the major outer dispensing opening and of said substantially congruent edge of the tab allowing exertion of downward compressive finger pressure at a location sufficiently close to the tearing web to indirectly apply tensile pressure with sufficient concentration to rupture the web and thereby initiate tearing of the web and opening of the tab.

2. A closure as in claim 1, in which said inner dispensing opening and said major outer dispensing opening are each circular.

3. A closure as in claim 2 in which said tab has a greater wall thickness than the remainder of said end wall and, prior to opening, engages the sides of said major outer dispensing opening to thereby act as a detent for said rotor at said one rotative position of said rotor at which the fully open dispensing condition of said end closure is to be established.

4. A container comprising a tubular body, a bottom end closure, and a top end closure, said top end closure being reclosable and comprising a one-piece plastic cap adapted to be secured to the top end of the container, said cap including a container end wall, said cap also including a punch-out tab defined by a reduced thickness tearing web formed in said end wall, groove means in said end wall extending from one or both surfaces of said end wall to said tearing web, hinge pin means molded integrally with said end wall and extending across said tearing web and groove means from said end wall proper to said punch-out tab, said tab having an arcuate edge at least at the side opposite said hinge pin means, rupture and tearing of said tearing web at the time of opening allowing said tab to hinge, on said hinge pin means, inwardly from said end wall to form an inner dispensing opening in the end wall, said end closure also including a rotor carried on said one-piece plastic cap, at least one dispensing opening formed in the rotor, said at least one opening being the major outer dispensing opening of the closure and having an arcuate edge which registers substantially congruently with said arcuate edge of said inner dispensing opening at the one rotative position of said rotor at which the fully open dispensing condition of said end closure is to be established, said hinge pin means being subject to failure during or following opening of the tab whereby if the hinge pin means breaks and the tab falls into the container then during dispensing the tab flows along with the contents of the container and tends to be dispensed therewith, said arcuate edge of said major outer dispensing opening having a given radius, the arcuate shape of said tearing web having a radius just exceeding said given radius to thereby establish potential interference fits of said tab with said major outer dispensing opening in all possible relative orientations between the two, whereby if said hinge pin means breaks, said tendency of the tab to be dispensed is positively overcome by an interference stop established by said interference fit, said arcuate shape of the major outer dispensing opening and of said substantially congruent edge of the tab allowing exertion of downward compressive finger pressure at a location sufficiently close to the tearing web to indirectly apply tensile pressure with sufficient concentration to rupture the web and thereby initiate tearing of the web and opening of the tab.

* * * * *